US006464089B1

(12) United States Patent
Rankin, VI

(10) Patent No.: US 6,464,089 B1
(45) Date of Patent: Oct. 15, 2002

(54) ADJUSTABLE SPRING-DRIVEN PUSHER DEVICE FOR A MERCHANDISE DISPENSER

(75) Inventor: Alexander Rankin, VI, Dresher, PA (US)

(73) Assignee: Vulcan Spring & Manufacturing Company, Telford, PA (US)

( * ) Notice: Subject to any disclaimer, the term of this patent is extended or adjusted under 35 U.S.C. 154(b) by 0 days.

(21) Appl. No.: 09/853,851

(22) Filed: May 11, 2001

(51) Int. Cl.[7] ..... A47F 1/12

(52) U.S. Cl. ..... 211/59.3; 312/71; 267/158; 267/166

(58) Field of Search ..... 211/59.3, 51; 312/71; 267/158, 160, 166

(56) References Cited

U.S. PATENT DOCUMENTS

| | | | | | |
|---|---|---|---|---|---|
| 3,342,536 | A | * | 9/1967 | Cohen | 312/71 |
| 3,357,760 | A | * | 12/1967 | Shelley et al. | 312/71 |
| 3,376,085 | A | * | 4/1968 | McPherson | 312/71 |
| 3,567,293 | A | * | 3/1971 | Salcman | 312/71 |
| 4,183,475 | A | * | 1/1980 | Martija | 242/68.3 |
| 4,303,162 | A | | 12/1981 | Suttles | 211/49 D |
| 5,012,936 | A | | 5/1991 | Crum | 211/59.3 |
| 5,131,563 | A | | 7/1992 | Yablans | 221/92 |
| 5,190,186 | A | * | 3/1993 | Yablans et al. | 221/124 |
| 5,562,217 | A | | 10/1996 | Salveson et al. | 211/59.3 |
| 5,634,564 | A | | 6/1997 | Spamer et al. | 211/59.3 |
| 5,878,895 | A | | 3/1999 | Springs | 211/59.3 |

* cited by examiner

*Primary Examiner*—Daniel P. Stodola
*Assistant Examiner*—Erica B Harris
(74) *Attorney, Agent, or Firm*—Howson and Howson

(57) ABSTRACT

A spring-driven pusher device for a forward, side, top, or up feeding merchandise dispenser having an adjustment mechanism for setting a desired pushing force. The adjustment mechanism is utilized to increase and/or reduce the tension of the windings of the coiled end of a spring or strip of coiled metal carried on the pusher device. The tension in the windings is increased if greater pushing force is desired, or decreased, if less pushing force is desired. Since the desired pushing force can be set, the same spring-driven pusher device can be utilized to feed various different products, regardless of size, shape, weight or surface texture.

15 Claims, 5 Drawing Sheets

ADJUSTABLE SPRING-DRIVEN PUSHER DEVICE FOR A MERCHANDISE DISPENSER

FIELD OF THE INVENTION

The present invention relates to an adjustable spring-driven pusher device for use on a forward feeding merchandise display shelf to dispense articles one by one from a front, or dispensing end, of the shelf, and more particularly, the present invention relates to a spring-driven pusher device that can be set to provide a predetermined amount of pushing force adjustable within a range of pushing forces.

BACKGROUND OF THE INVENTION

Many stores, particularly retail stores, outlet stores and the like, store and display products on shelves from which purchasers can select and remove one or more of the products from the shelves. Such shelves are typically provided with a forward feeding pusher device so that a substantially horizontal stacked row of identical products located in front of the pusher device is biased toward the front end, or dispensing end, of the shelf to force the products remaining in the row to be pushed forward when one of the products from the front end of the shelf is removed. In such a forward feeding device, the pusher can extend upwardly from a track located below the products, downwardly from a track located above the products, or laterally from a track extending adjacent the sides of the products. Alternatively, the pusher device can extend from a substantially vertical track and be utilized to up-feed, or down feed, a vertically stacked column of products.

Examples of such merchandiser assemblies are disclosed in U.S. Pat. No.: 4,303,162 issued to Suttles; U.S. Pat. No. 5,634,564 issued to Spamer et al.; U.S. Pat. No. 5,012,936 issued to Crum U.S. Pat. No. 5,562,217 issued to Salveson et al.; U.S. Pat. No. 5,878,895 issued to Springs; and U.S. Pat. No. 5,131,563 issued to Yablans.

One problem presented by the use of such merchandiser assemblies is that the product being stored and displayed often range significantly in size, shape, surface texture, and weight. For example, some products are lightweight and sold in relatively small rectangular boxes or cartons (ie. breakfast cereals), whereas other products may be relatively heavy and be packaged in plastic containers or the like (ie. bottles of motor oil). Thus, depending on which product is to be stored and displayed on a particular shelf, a spring providing a desired amount of pushing force must be selected and installed in the spring-driven pusher device. For example, a spring sufficiently strong to forward feed relatively heavy items, or items which resist sliding, may be too strong for use in feeding relatively lightweight or readily slidable items, and conversely, a spring sufficient to forward feed relatively lightweight items may not be capable of pushing relatively heavy items.

Therefore, there exists a need for a universal spring-driven pusher device which can provide a selected pushing force within a wide range of forces so that the same spring-driven pusher device can be used in connection with products that range significantly in size, shape, surface texture and weight.

U.S. Pat. No. 4,303,162 issued to Suttles, cited above, discloses a forward feeding merchandising device for soft drink bottles. The Suttles patent discloses a pusher device driven by a positive gradient, ie. variable force, self-coiling metal spring. The Suttles patent states that a positive gradient spring is preferred since it exerts greater force when fully extended and less force as the spring becomes further retracted. In addition, the Suttles patent discloses the use of an adjustable angled pusher plate which can be utilized to adjust the pushing force provided by the spring-drive pusher device. To this end, the Suttles patent states that the force is maximized hen the plate extends perpendicular from the track and is reduced when the plate is bent forward to reduce the angle formed between the plate and the track. See column 7, line 44, to column 8, line 2, of the Suttles patent.

U.S. Pat. No. 5,634,564 issued to Spamer et al., cited above, discloses another spring -driven pusher device for dispensing articles. The Spamer patent discloses the use of a self-coiling metal spring having a two-stage structure. The spring has a coiled end portion with innermost windings acting as a constant force spring and outermost windings acting as a variable force spring. See FIG. 12 and column 7, lines 6–65, of the Spamer patent. According to Spamer, the purpose of the constant force spring inner windings is to prevent excessive force from being exerted on a fully loaded row of articles.

Although the above referenced merchandiser assemblies having spring-driven pusher devices may be satisfactory for their intended purposes, there is a need for a novel universal spring-driven pusher device which permits ready adjustment of the pushing force provided by the pusher device so that, when a shelf is utilized to store and display a different product type, the same pusher device and spring can be utilized regardless of the shape, weight, surface texture, or size of the newly stored and displayed product. Further, the pushing force should be capable of ready and precise adjustment within fine increments so that the universal spring-driven pusher device can be set to provide a proper amount of pushing force specifically required for the selected product. In addition, the spring-loaded pusher device should be inexpensive to manufacture and easy to adjust.

OBJECTS OF THE INVENTION

With the foregoing in mind, a primary object of the present invention is to provide a novel universal spring-driven pusher device which can be utilized to forward-fee, up-feed, top-feed, or side-feed merchandise in a dispenser for products within a great range of weights, sizes, shapes, and surface textures and which does not require replacement when one type of merchandise in the dispenser is replaced with another type of merchandise significantly different in weight, size, shape and/or surface texture.

Another object of the present invention is to provide a novel spring-driven pusher device which enables accurate incremental adjustment of pushing force within a wide range of forces.

A further object of the present invention is to provide a method of adjusting the pushing force provided by a spring-driven pusher device, the method should require only a minimum of effort and skill and permit ready adjustment in a minimum of time.

A still further object of the present invention is to provide an adjustable spring-driven pusher device which can be readily manufactured in a cost efficient manner.

SUMMARY OF THE INVENTION

More specifically, the present invention provides a spring-driven pusher device for an article dispenser that includes an elongate track having a dispensing end and an opposite end and an elongate surface for positioning a row of articles for movement therealong between the dispensing end and the opposite end of the track. The track can be disposed parallel or perpendicular to the horizontal or at any angle relative to the horizontal and can be positioned below, above, or adjacent the sides of the articles being dispensed. A pusher extends outwardly from the track and is connected to the track for movement lengthwise along the track between the dispensing and opposite ends for urging the row of articles toward the dispensing end of the track.

Preferably, a flat metal self-coiling spring, such as a steel variable force spring or a steel power spring or a flat elongate strip of metal which is placed in a coiled condition, exerts a force on the pusher to urge the pusher toward the dispensing end of the track. To this end, the spring, or trip, has a coiled end portion that is carried on the pusher and an opposite uncoiled end portion which is connected to the track. Alternatively, the spring, or strip, has a coiled end portion that is connected to the track and an uncoiled end portion which is carried on the pusher. The coiled end portion includes multiple windings under tension about an axis and a terminal end located adjacent the axis. Preferably, a slotted arbor extends along the axis of the coiled end portion and is connected to the terminal end of the coiled end portion. Alternatively, the terminal end portion can be connected to the arbor with a screw or like fastening device.

The arbor is rotatably mounted to one of the pusher or the track so that the tension of the windings of the coiled end portion is adjustable by rotation of the arbor. Thus, the pushing force provided by the spring, or strip, of the pushing device is readily adjustable in a store by store personnel by increasing or reducing the tension of the winding the coiled end portion of the spring, or strip.

According to another aspect of the present invention, a method is provided for loading a forward, side, top, or up feeding merchandising apparatus. The method includes the step of positioning a row, or column, of articles in front of, or on top of, a pusher device. The pusher extends transversely to a path of movement of the articles for movement lengthwise along a track between the dispensing end and opposite end of the track and urges the articles toward the dispensing end. In addition, the method includes the step of setting the pusher to provide a desired amount of pushing force. To this end, the pusher is connected to a self-coiling variable force spring, a self-coiling power spring or a flat strip of metal positioned in a coiled condition.

The self-coiling spring, or strip, has a coiled end portion with multiple windings under tension, and the step of setting the pusher includes adjusting the tension of the windings of the coiled end portion of the spring, or strip. Preferably, the pusher includes a rotatable arbor extending along an axis of the coiled end portion, and a terminal end of the coiled end portion is mounted on the arbor for rotation with the arbor. The step of setting the pusher includes rotating the arbor to adjust the tension of the windings of the coiled end portion. In addition, preferably the step of setting the pusher includes locking the arbor in a condition which prevents rotation of the arbor about the axis of the coiled end portion after a desired tension of the windings is set.

BRIEF DESCRIPTION OF THE DRAWINGS

The foregoing and other objects, features and advantages of the present invention should become apparent from the following description when taken in conjunction with the accompanying drawings, in which.

DETAILED DESCRIPTION OF THE PREFERRED EMBODIMENT

Figure 1:
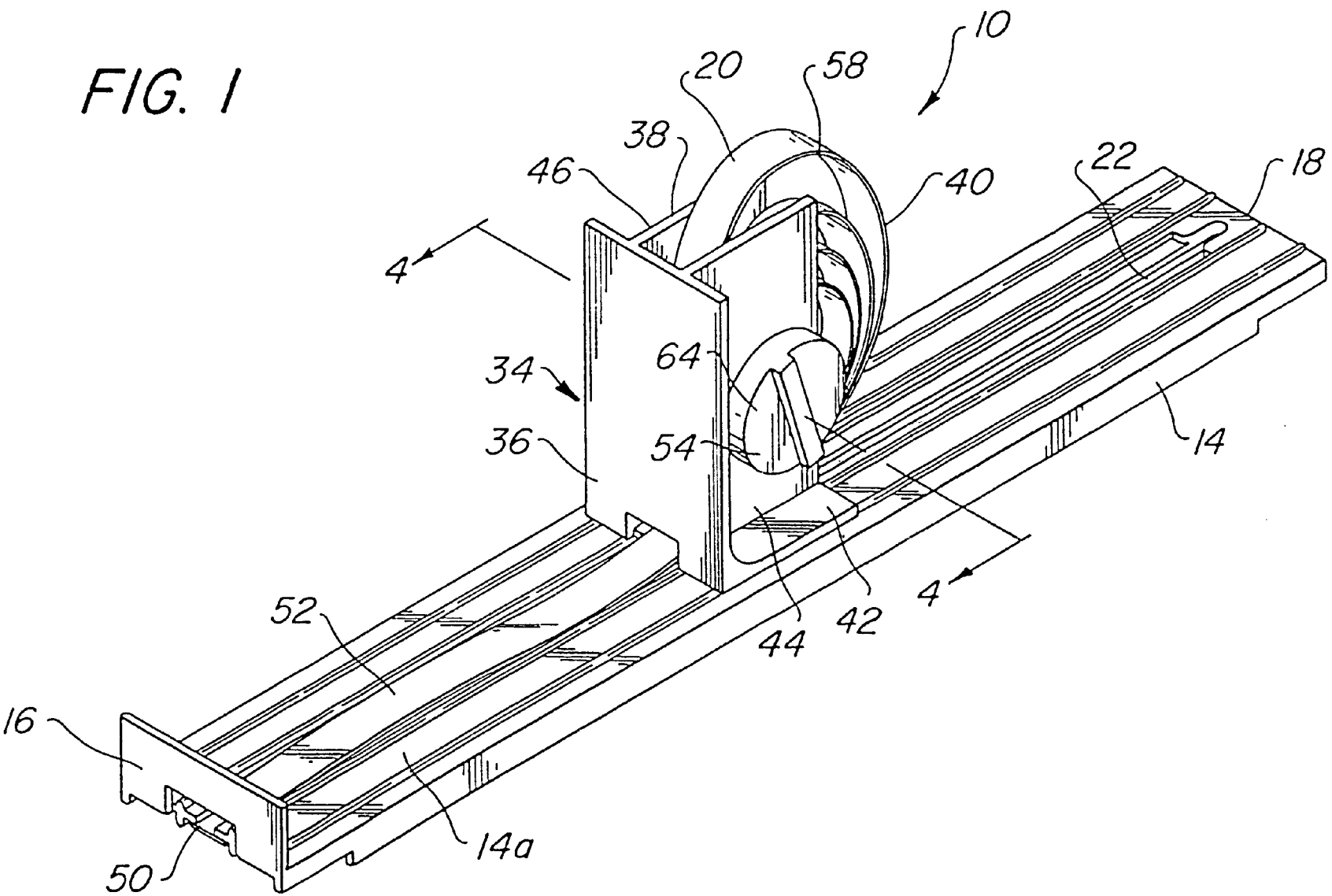
FIG. 1 is a perspective view of a spring-driven pusher device according to the present invention.
Figure 2:
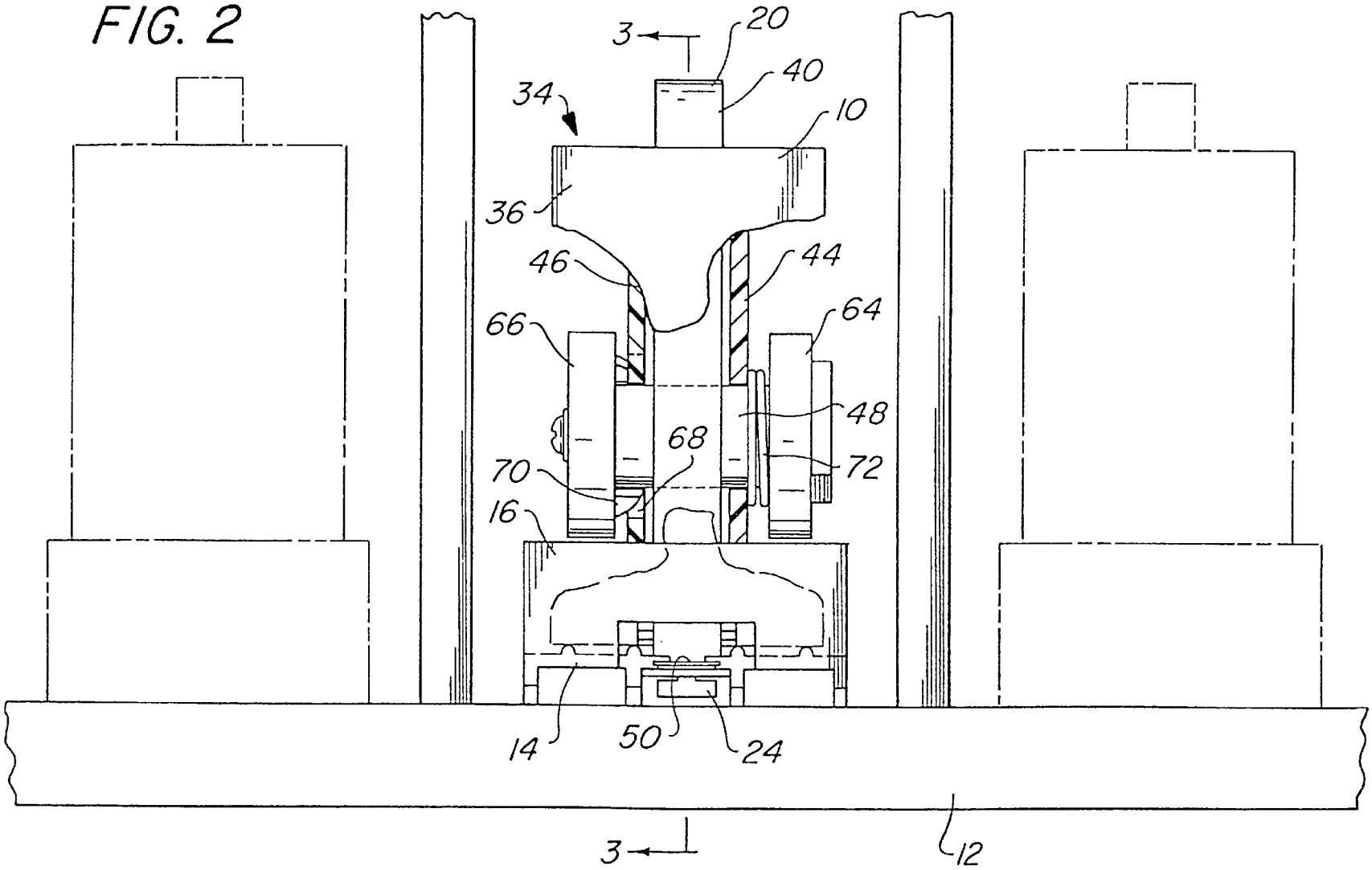
FIG. 2 is a partially cut-away front elevational view of the spring-driven pusher device illustrated in FIG. 1 mounted on a shelf.

As illustrated in FIG. 1, the present invention is a spring-driven pusher device 10 for use on a shelf 12, such as illustrated in FIG. 2, for forward feeding merchandise (not shown) stored and displayed on the shelf 12. For example, several boxes of a particular breakfast cereal, or like articles, can be positioned in a single file row one behind the other on the shelf 12 such that a leading box is located at a front dispensing end of the shelf 12. Thereafter, the leading box can be removed from the shelf 12 by purchaser, and the pusher device 10 will urge the remaining boxes forward to provide a new leading box adjacent the front end of the shelf 12. Although not illustrated, the pusher device 10 of the present invention can also be utilized in up-feeding, side-feeding, and top-feeding merchandise dispensers.

Similar to the prior art, the illustrated embodiment of the present invention includes an elongate track 14 having a front dispensing end 16, an opposite rear end 18 and an elongate surface 14*a* facing the row of articles. The track 14 is removably mountable to a shelf 12, and articles are positioned on the track 14 in a row such that the leading article is located adjacent the front end 16 and the rearmost article is located adjacent the rear end 18 of the track 14. Alternatively, the track 14 can be mounted to extend above, or to the side of, the stacked articles on the substantially horizontal or slightly angled, shelf 12, or can be mounted vertically or at a steep angle relative to the horizontal for up-feeding a column of stacked articles to a dispensing end.

Figure 4:
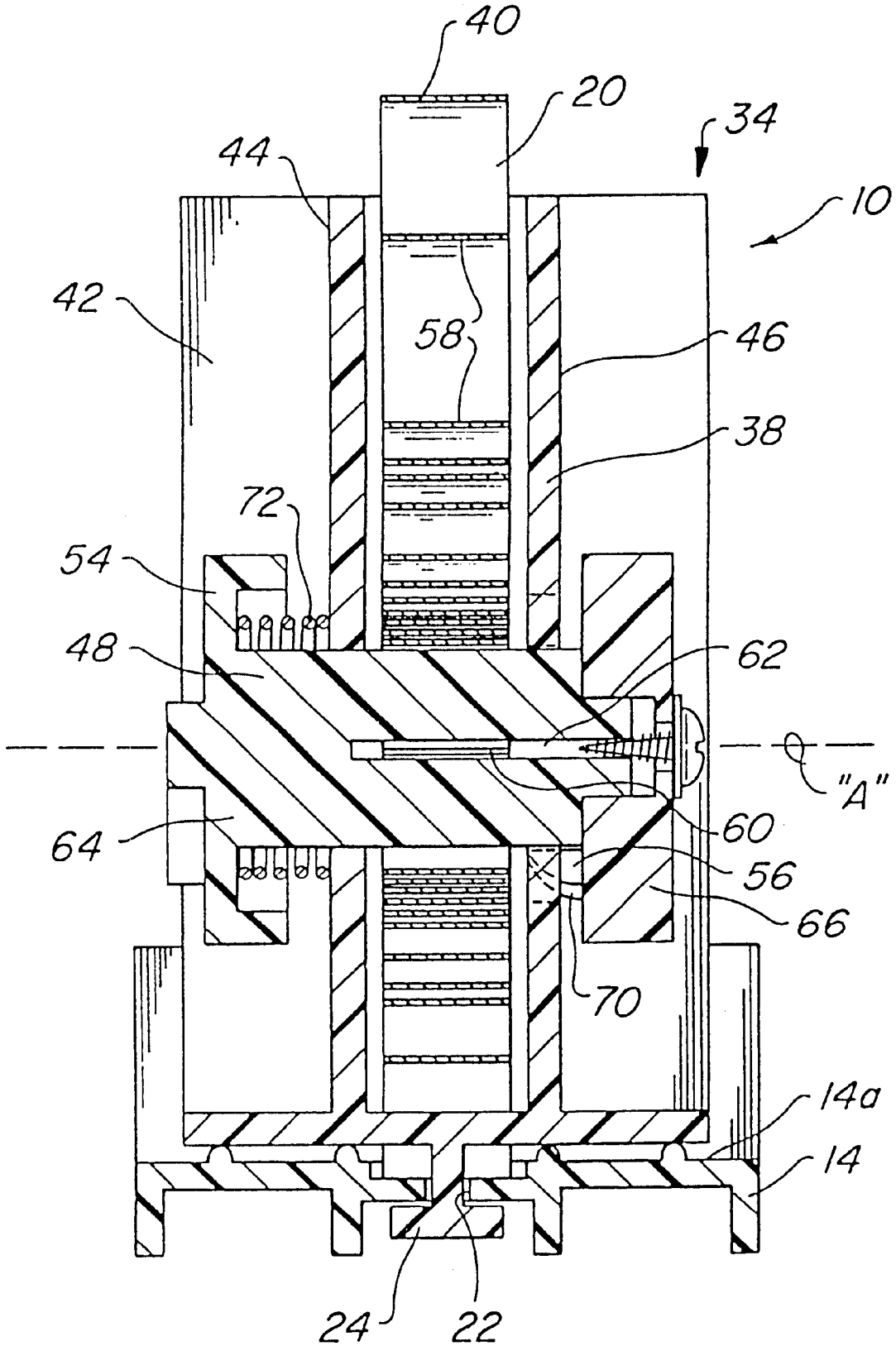
FIG. 4 is a cross-sectional view of the spring-driven pusher device illustrated in FIG. 1 along line 4—4.
Figure 5:
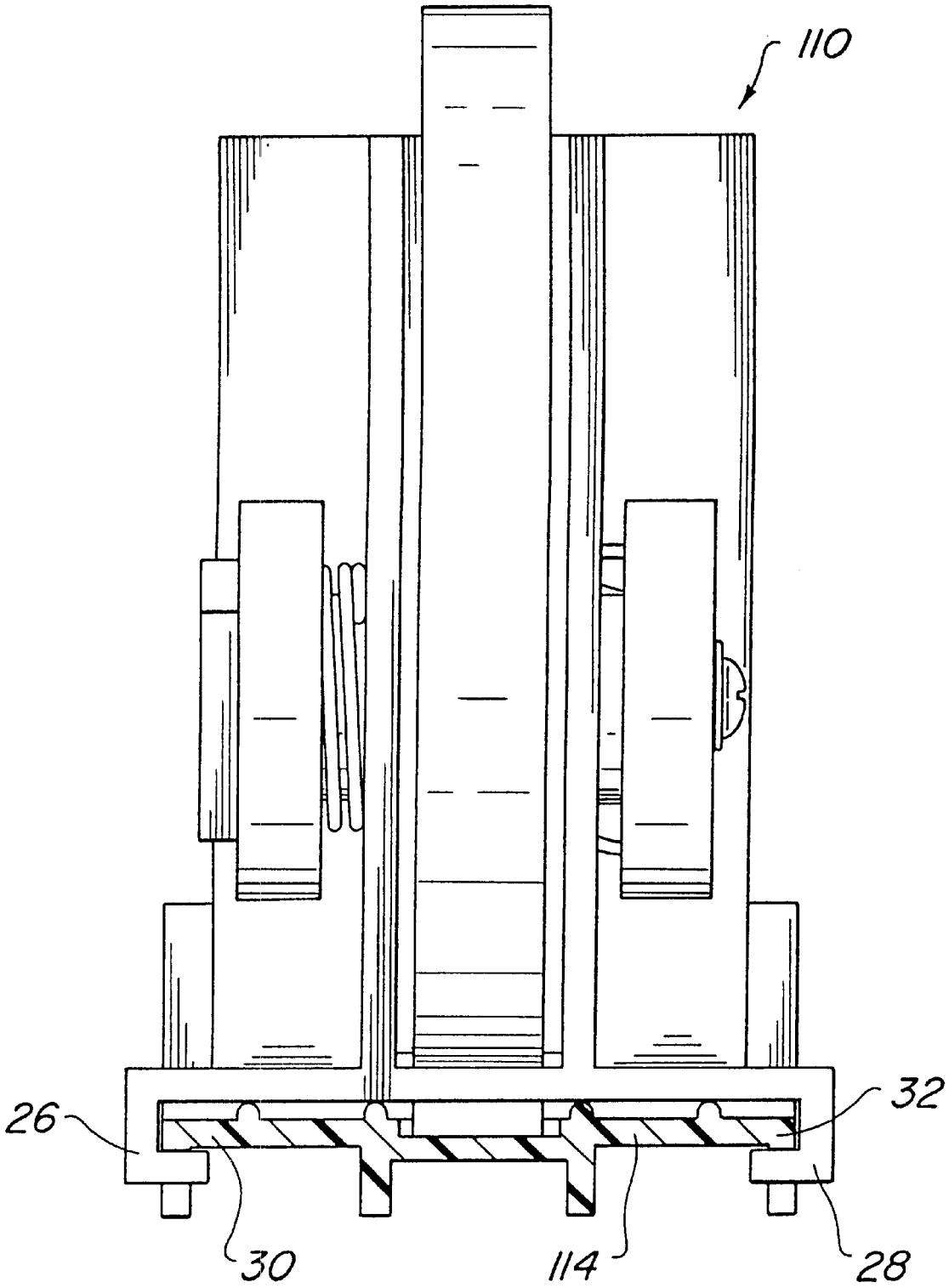
FIG. 5 is a rear elevational view of an alternate embodiment of a spring-driven pusher device according to the present invention and mounted on a shelf.

The pusher device 10 is mounted on the track 14 in a manner which permits movement of the pusher device 10 between the dispensing end 16 and the opposite end 18 of the track 14. Thus, the pusher device 10 is moved rearwardly, or toward the opposite end 18, to load a row of articles on the shelf 12 and is resiliently biased forward, or toward the dispensing end 16, by a spring/strip 20, as will be discussed in greater detail. As best illustrated in FIGS. 1 and 4, the track 14 includes an elongate slot 22 extending longitudinally, or lengthwise, on the track 14 and utilized to capture a flange 24 extending from the pusher device 10. In this manner, the pusher device 10 engages the surface 14*a* of the track 14 and is free to slide in a straight path between the front dispensing and opposite rear ends, 16 and 18, of the track 14. Alternatively, the pusher device 110 as illustrated in FIG. 5 has a pair of side flanges 26 and 28 which grip about the outer side edges 30 and 32 of the track 114. This configuration also permit the pusher device to slide in a straight path between the ends of the track. Other contemplated alternatives include the use of rollers, ball bearings, wheels or the like to permit the pusher device to readily move across the track.

The pusher device 10 includes a pusher plate 34 which extends outwardly, or transversely, from the track 14 and which has a front surface 36 that engages the rearmost article of the row, or column, of stacked articles. The pusher plate 34 also includes spring retaining structure 38 which permits a coiled end portion 40 of a self-coiling spring, or strip, 20 to be carried on a rear side 42 of the pusher plate 34. Alternatively, the coiled end portion 40 of the spring 20 could be mounted on the track 14, and the free end 50 of the spring 20 opposite from the coiled end portion 40 could be attached to the pusher plate 34.

In the illustrated preferred embodiment, the spring retaining structure 38 is located on the pusher plate 34 and includes a pair of spaced apart, parallel retaining flanges, 44 and 46, which extend rearwardly from the rear side 42 of the pusher plate 34. A terminal end 60 of the coiled end portion 40 is mounted on an arbor 48 which extends transversely with respect to the retaining flanges, 44 and 46, and which is mounted the retaining flanges, 44 and 46. Thus, the terminal end 60 and coiled end portion 40 of the illustrated embodiment is carried on the pusher plate 34 adjacent the rear side of the pusher plate 34 between the retaining flanges 44 and 46 and is wound about the arbor 48.

Preferably, the free end 50 of an uncoiled portion 52 of the spring 20 remote from the coiled end portion 40 is connected to the track 14 adjacent its dispensing end 16. Therefore, when the pusher plate 34 is moved rearwardly on the track 14, the spring uncoils and applies a force on the pusher plate 34 in a direction toward the front dispensing end 16 of the track 14.

Preferably, the spring/strip, or force exerting mechanism, 20 is a flat metal self-coiling spring or a flat strip of metal which is placed in a coiled condition. Examples of a metal self-coiling spring include a steel variable force spring and a steel power spring. As discussed in the prior art, preferably the pushing force provided by the spring/strip 20 should gradually reduce as the pusher plate approaches the front end 16 of the track 14 and as the spring/strip 20 transitions from being fully extended in a non-coiled condition to being fully retracted in a coiled condition. Thus, such a spring advantageously exerts a maximum force when the shelf 12 is fully loaded with a full row of articles and exerts a progressively reduced amount of force as the leading articles of the row are removed one by one until all the articles are removed from the shelf 12.

In the prior art, the maximum and minimum amount of pushing force exerted by the spring depends on the particular strength of spring selected and installed on the pusher device. Thus, the prior art devices require changes to the merchandise assembly and spring when a different article having a different size, shape, weight and/or surface texture is stored on the shelf. Obviously, heavier articles, or articles that do not readily slide across the shelf due to friction, require stronger springs and greater pushing forces than lightweight articles, or articles that are capable of readily sliding across the shelf with a relatively light amount of force.

One of the novel features of the present invention is that it has a spring adjustment mechanism 54 for adjusting the pushing force provided by the spring/strip 20 so that a given pusher device 10 having a single spring/strip 20 can be utilized in connection with many different products which may have significantly different weights, surface textures, shapes and sizes. To this end, the pushing force provided by the pusher plate 10 of the present invention can be precisely set to deliver a desired pushing force within a wide range of forces. Thus, the same pusher device 10 can be set to properly feed a row, or column, of relatively heavy articles toward the dispensing end 16, and then, reset to properly feed a row, or column, of relatively lightweight articles toward the dispensing end 16.

The illustrated embodiment of the spring adjustment mechanism 54 of the present invention includes the use of a rotatable arbor 48 and an arbor locking mechanism 56 as will be discussed. As best illustrated in FIG. 4, the arbor 48 extends through the central axis "A" of the coiled end portion 40 of the spring/strip 20. The coiled end portion 40 includes a plurality of windings 58 about the arbor 48 and has a terminal end 60 located adjacent to axis "A". The terminal end 60 is inserted into a slot 62 in the arbor 48 for rotation therewith. Alternatively, the terminal end can be connected to the arbor with a screw or like fastener, or can be connected to a stud extending from the arbor. Thus, since the arbor 48 is rotatably mounted to the spring retaining flanges, 44 and 46, when the arbor is rotated clockwise, or counter clockwise, relative to axis "A", the windings 58 are caused to loosen or tighten.

Figure 3:
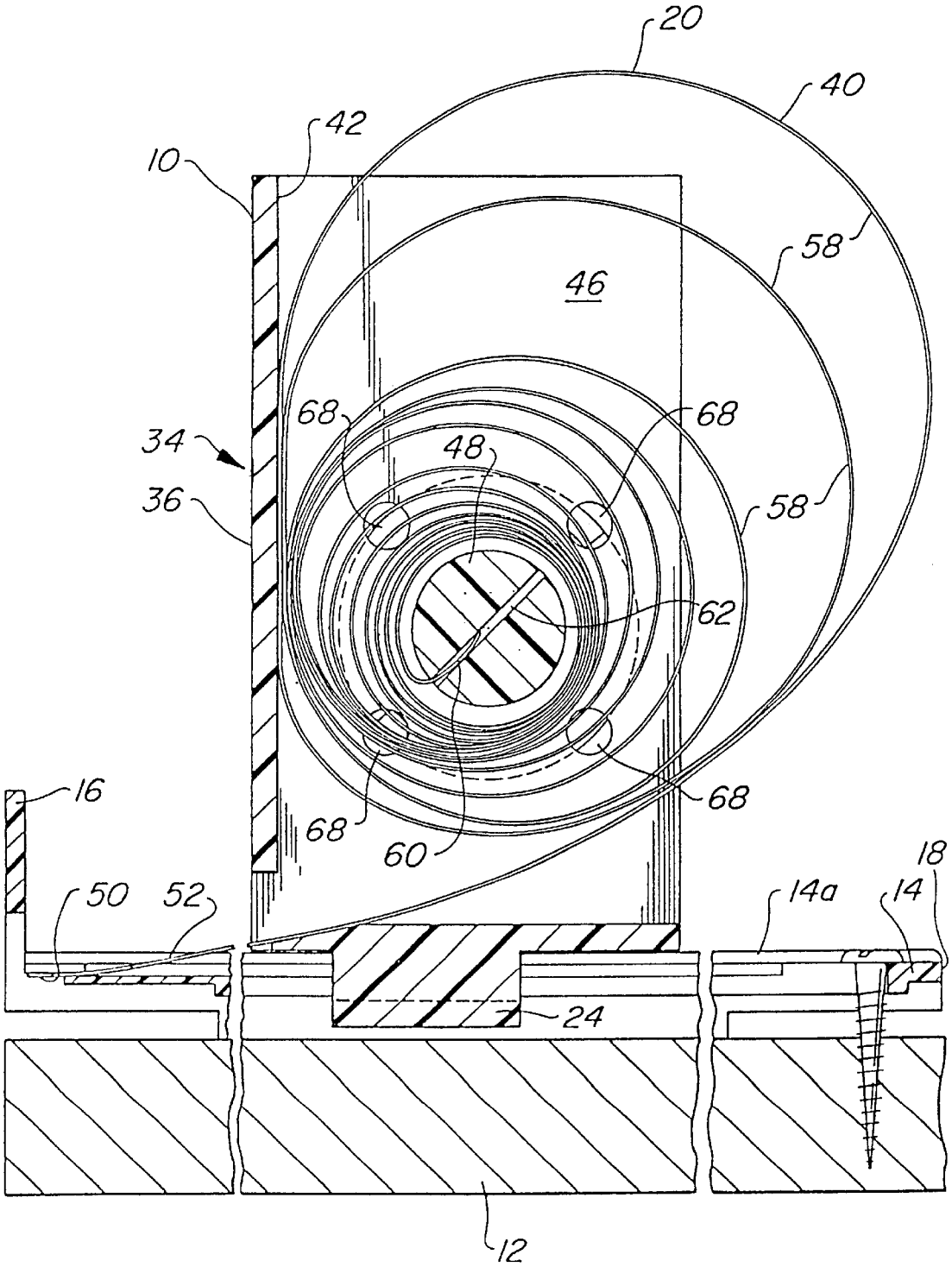
FIG. 3 is a cross-sectional view of the spring-driven pusher device illustrated in FIG. 2 along line 3—3.

Referring to FIG. 3, as the illustrated arbor 48 is progressively rotated in a counter clockwise direction, the windings 58 will progressively become more tightly wound onto the arbor 48. Conversely, if the arbor 48 in FIG. 3 is rotated clockwise, the windings 58 will be less tightly wound on the arbor 48. A pushing device having a tightly wound coiled end portion exerts a greater amount of pushing force than a pushing device with a loosely wound coiled end portion. Thus, the pushing device 10 can be se with a desired amount of pushing force by tightening or loosening the tension of the windings 58 of the coiled end portion 40.

After the tension of the windings 58 is set, the arbor locking mechanism 56 is utilized to prevent the arbor 48 from rotating so that the spring 20 exerts the desired set force. To this end, as best illustrated in FIG. 4, the arbor 48 extends through the spring retaining flanges, 44 and 46, and has opposite end wall flanges, 64 and 66, located exterior of the spring retaining flanges, 44 and 46. This structure mounts the arbor 48 to the pusher plate 34 and permits the arbor 48 to be rotated for increasing and decreasing the tension of the windings 58 of the coiled end 40 of the spring. Preferably, the retaining flange 46 includes a series of apertures 68 and the end wall flange 66 includes at least one locking projection 70 which can be cooperatively received in one of the apertures 68 for preventing further rotation of the arbor 48. In addition, preferably a spring 72 or the like is located between the retaining flange 44 and the end wall flange 64 to resiliently bias the arbor 48 in a direction which prevents unwanted removal of the locking projection 70 from the aperture 68. When rotation of the arbor 48 is desired, the end wall flange 64 is grasped, pushed inwardly to release the projection 70 from the aperture 68, and rotated. This provides a ready means of rotating the arbor 48 when an adjustment is desired and of locking the arbor 48 in a non-rotatable condition after the desired pushing force has been accurately set.

While a particular locking mechanism 56 is illustrated and discussed, other locking mechanism can be utilized. For example, any amount of apertures 68 and projections 70 can be utilized, and the relative location of the apertures 68, projections 70, and spring 72 on the retaining flanges, 44 and 46, and end wall flanges, 64 and 66, can be altered. In addition, a ratchet-type locking mechanism, a friction-fit type locking mechanism, or any other type of locking mechanism can be utilized. The illustrate locking mechanism 56 merely provides one example. Further, the locking mechanism can be designed to lock the arbor 48 at discreet intervals of adjustment, or can provide continuous adjustment and lock at any position.

In use, an employee of a store responsible for loading the shelf 12 with articles adjusts the tension of the spring/strip 20 as desired to provide an appropriate amount of force to feed articles toward the dispensing end 16. If the pushing force is determined to be too weak for a particular row or column of articles, the arbor 48 can be rotated to increase the tension of the windings 58 and can then be locked into position to hold the selected tension. Alternatively, if the pushing force is determined to be too strong for a particular row or column of articles, the arbor 48 can be rotated to reduce the tension of the windings 58 and then locked into position to hold the selected tension. The articles can be positioned onto the shelf 12 with the pushing plate 34 engaging a rearmost article in the row for feeding the row of articles to the dispensing end 16.

Thus, the pusher device according to the present invention provides a universal pusher device for use in forward, side, top and up feeding various products regardless of the amount of pushing force required. The pushing force can be readily adjusted as needed, and can be accurately set to ensure proper feeding of a stacked row or column of articles to a dispensing end of the merchandise dispenser. The pushing force can be set in a minimum of time with a minimum of effort, and the manufacture of the pushing device can be accomplished in a cost effective manner.

While a preferred spring-driven pusher device has been described in detail, various modifications, alterations, and changes may be made without departing from the spirit scope of the present invention as defined in the appended claims.

What is claimed is:

1. A pusher device for an article dispenser, comprising:

an elongate track having a dispensing end, an opposite end, and a surface portion extending lengthwise of said track between said dispensing and opposite ends;

a pusher extending outwardly from said surface portion of said track and being movable lengthwise along said track between said dispensing and opposite ends for controllably moving toward said dispensing end a plurality of articles positioned along said surface portion;

a force exerting mechanism connected to said pusher and exerting a force on said pusher to urge said pusher toward said dispensing end of said track, said force exerting mechanism having a coiled end portion with multiple windings under tension and a terminal end located adjacent an axis of said coiled end portion; and an adjustment mechanism engaging said coiled end portion and being adapted to tighten and loosen said windings for permitting adjustment of said force exerted by said force exerting mechanism on said pusher, said adjustment mechanism including an arbor extending within said coiled end portion, said terminal end being connected to said arbor and said arbor being rotatable to alter said tension of said windings thereby adjusting said force exerted on said pusher.

2. A pusher device according to claim 1, wherein said force exerting mechanism is selected from the group consisting of a self-coiling spring, a variable force spring, a power spring, and a flat strip of metal positioned into a coiled condition.

3. A pusher device according to claim 1, wherein said pusher has an article-engaging side facing toward said dispensing end of said track and a rear side on which said coiled end portion is carried.

4. A pusher device according to claim 3, further comprising a pair of spring retaining flanges extending from said rear side of said pusher, said flanges extending transversely relative to said arbor for mounting said arbor to said pusher.

5. A pusher device according to claim 3, wherein said force exerting mechanism has a leading end opposite from said terminal end of said coiled end portion, wherein said leading end is connected to a portion of said track adjacent said dispensing end of said track.

6. A pusher device according to claim 1, further comprising a locking mechanism for preventing said arbor from rotating after a desired tension of said windings of said coiled end portion is set.

7. A spring-driven pusher device for an article dispenser, comprising:

an elongate track having a dispensing end, an opposite end, and a surface portion extending lengthwise of said track between said dispensing and opposite ends;

a pusher extending outwardly from said surface portion of said track and connected to said track for movement lengthwise along said track between said dispensing and opposite ends;

a force exerting mechanism having a coiled end portion carried by said pusher and exerting a force on said pusher to urge said pusher toward said dispensing end of said track, said coiled end portion including multiple windings which are under tension and which define an axis, and said coiled end portion having a terminal end located adjacent said axis; and an arbor extending along said axis and connected to said terminal end of said coiled end portion, said arbor being rotatably mounted to said pusher so that said tension of said windings of said coiled end portion is adjustable by rotation of said arbor.

8. A spring-driven pusher device according to claim 7, further comprising a locking mechanism for preventing said arbor from rotating after a desired tension of said windings of said coiled end portion is set.

9. A spring-driven pusher device according to claim 8, wherein said pusher has an article-engaging side facing toward said dispensing end of said track and a rear side on which said coiled end portion is carried; wherein said force exerting mechanism has a leading end opposite from said terminal end of said coiled end portion; and wherein said leading end is connected to a portion of said track adjacent said dispensing end of said track.

10. A spring-driven pusher device according to claim 9, further comprising a pair of spring retaining flanges extending from said rear side of said pusher, said flanges extending transversely relative to said arbor for mounting said arbor to said pusher.

11. A spring-driven pusher device according to claim 7, wherein said arbor is a slotted arbor having a securement slot into which said terminal end is inserted and secured.

12. A spring-driven pusher device according to claim 7, wherein said force exerting mechanism is selected from the group consisting of a self-coiling spring, a variable force spring, a power spring, and a flat strip of metal positioned in a coiled condition.

13. A method of setting a merchandise feeding device, comprising the steps of:

positioning a series of articles in a dispenser ahead of a pusher which extends transversely to a path of movement of said articles and which urges said articles along said path toward a dispensing end of said dispenser; and setting said pusher to provide a desired amount of pushing force;

said pusher being connected to a force exerting mechanism having a coiled end portion with multiple windings under tension and having a rotatable arbor extending within said coiled end portion, said coiled end portion having a terminal end mounted on said arbor for rotation with said arbor; and said step of setting said pusher including rotating said arbor to adjust said tension of said windings of said coiled end portion.

14. A method according to claim 13, wherein said step of setting said pusher includes locking said arbor in a condition which prevents rotation of said arbor about said axis of said coiled end portion after a desired tension of said windings is set.

15. A method according to claim 13, wherein said force exerting mechanism is selected from the group consisting of a self-coiling spring, a variable force spring, a power spring, and a flat strip of metal positioned in a coiled condition.

* * * * *